US005893520A

United States Patent [19]

Elkas

[11] Patent Number: 5,893,520

[45] Date of Patent: Apr. 13, 1999

[54] ULTRA-DRY FOG BOX

[76] Inventor: Michael V. Elkas, 28 Franklin St., Ramsey, N.J. 07446

[21] Appl. No.: 08/838,156

[22] Filed: Apr. 14, 1997

Related U.S. Application Data

[63] Continuation-in-part of application No. 08/474,947, Jun. 7, 1995, Pat. No. 5,620,142.

[51] Int. Cl.[6] ..... B05B 1/26

[52] U.S. Cl. ..... 239/499; 239/518; 239/520; 239/590; 239/597

[58] Field of Search ..... 239/499, 500, 239/518, 520, 589, 590, 597; 261/78.2, DIG. 65

[56] References Cited

U.S. PATENT DOCUMENTS

| | | | |
|---|---|---|---|
| 921,205 | 5/1909 | Cramer | 239/524 |
| 1,761,422 | 6/1930 | Wagner | 239/512 |
| 1,940,171 | 12/1933 | Huss | 239/DIG. 19 |
| 2,009,932 | 7/1935 | Klotzman | 239/DIG. 19 |
| 2,540,663 | 2/1951 | Garey | 239/518 |
| 2,701,165 | 2/1955 | Bete et al. | 239/512 |
| 3,606,159 | 9/1971 | Sutton | 261/78.2 X |
| 3,894,691 | 7/1975 | Mee | 239/524 |
| 4,150,794 | 4/1979 | Higgins | 239/596 |
| 4,244,521 | 1/1981 | Guse | 239/596 |
| 4,869,430 | 9/1989 | Good | 239/524 |
| 4,990,290 | 2/1991 | Gill et al. | 261/78.2 X |
| 5,033,681 | 7/1991 | Munoz | 239/DIG. 19 |
| 5,240,648 | 8/1993 | Gill et al. | 261/78.2 X |
| 5,620,142 | 4/1997 | Elkas | 239/518 |

FOREIGN PATENT DOCUMENTS

| | | | |
|---|---|---|---|
| 540399 | 9/1954 | Belgium | 239/518 |
| 0-226611 | 11/1985 | Japan | 239/596 |
| 1376591 | 12/1974 | United Kingdom | 239/596 |

*Primary Examiner*—Lesley D. Morris

*Attorney, Agent, or Firm*—Panitch Schwarze Jacobs & Nadel, P.C.

[57] ABSTRACT

The present invention comprises an ultra-dry fog box for the emission of a fog along a dimension, comprising a fog retention enclosure, having a length along which a fog is desired. In principal part, the enclosure includes at least one emission opening along the length of the enclosure for the emission of a fog. The enclosure further includes at least one inlet passage permitting the intake of ambient air and an internal circuitous path within the enclosure comprising a flow path between the inlet passage and the emission opening. The flow path includes at least in part, a near reversal of a flow from a gravitational direction. The enclosure further includes the capability to create a flow of ambient air into the inlet passage of the enclosures, and out of the enclosure through the emission opening. At least one pin jet nozzle is included in the enclosure to provide a fog, with the nozzle placed so that fluid discharged from the nozzle will enter the flow path.

32 Claims, 3 Drawing Sheets

ULTRA-DRY FOG BOX

This application is a continuation-in-Part of U.S. patent application Ser. No.: 08/474,947, filed Jun. 7, 1995, now U.S. Letters Pat. No. 5,620,142, and claims priority of U.S. patent application Ser. No.: 07/919,164, filed Jul. 23, 1992, now abandoned.

BACKGROUND OF THE INVENTION

1. Field of the Invention

The present invention relates to an ultra-dry fog box, for use in providing a fog along a dimension. In particular, the present invention relates to an ultra-dry fog box for the emission of a fog along a dimension, comprising a fog retention enclosure, having a length along which a fog is desired. The enclosure comprises at least one emission opening along its length for the emission of a substantially uniform fog. At least one inlet passage is located in the enclosure, permitting the intake of ambient air into the enclosure. An internal circuitous path is located within the enclosure, comprising a flow path in fluid communication between the inlet passage and the emission opening and including, at least in part, a near-reversal of flow from a gravitational direction. The enclosure further includes a means for creating a flow of ambient air into the enclosure through the inlet passage, and out of the enclosure through the emission opening. At least one pin jet nozzle is provided in the enclosure and is adapted for use in providing a fog. The pin jet nozzle is located proximate to the inlet passage or within the enclosure so that fluid discharged from the pin jet nozzle enters the flow path.

In a preferred embodiment, the device of the present invention provides an ultra-dry fog box for the emission of a fog along a dimension, including a fog retention enclosure having a length along which a fog is desired. The enclosure comprises at least one emission opening along its length for the emission of a substantially uniform fog, and at least one inlet passage permitting the intake of ambient air into the enclosure. The enclosure further includes an internal circuitous path comprising a flow path in fluid communication between the inlet passage and the emission opening, and including, at least in part, a near-reversal of a flow from a gravitational direction. The enclosure further includes means for creating a flow of ambient air into the enclosure through the inlet passage and out of the enclosure through the emission opening. The enclosure further includes at least one improved pin jet nozzle which is adapted for use in providing a fog consisting essentially of fluid particles having a diameter of less than fifty micrometers. The nozzle comprises a base portion which includes a means for connecting the nozzle to a pressurized hydraulic system, a means for receiving fluid from the hydraulic system, and an orifice component. The orifice component includes an inlet adapted to receive fluid from the hydraulic system, an outlet orifice for the release of fluid from the system in the form of a jet, and a delivery channel which is adapted to convey fluid from the inlet to the outlet orifice. The nozzle further comprises a pin portion which includes a support and centering means, and an impingement pin member mounted upon the support and centering means which is positioned over the outlet orifice, wherein the impingement pin member has an impingement face in the path of the fluid jet which is substantially similar in dimension to the diameter of the fluid jet. Further, the nozzle includes a nozzle insert which includes an insert member comprising a hollow, generally cylindrical insert which is adapted to be held firmly within the outlet orifice of the base portion, and an orifice member which is held firmly within the generally cylindrical insert member. The orifice member comprises a wear-resistant material, a central orifice with a diameter of from about three one-thousandths of an inch (0.003 inch) to about fifteen one-thousandths of an inch (0.015 inch), and a high degree of concentricity, with a variance in the concentricity of the central orifice of less than five ten-thousandths of an inch (0.0005 inch). The pin jet nozzle is located proximate to the inlet passage or within the enclosure so that fluid discharge from the pin jet nozzle will enter the flow path.

In a still further preferred embodiment, these devices of the present invention further provide at least one mesh filter disposed within said flow path for fluid particles.

2. Description of Related Art

Evaporative cooling systems have been employed in various applications for a number of years. Such systems typically involve a pressurized fluid, usually water, escaping through a small orifice and impinging on a proximate surface. The force of the pressurized stream against the proximate surface causes the fluid to disperse into minute particles creating a localized fog. A fog differs from a mist, although the terms are often used imprecisely. As used herein, a fog contains small droplets which evaporate from the air rather than falling to cause a localized wetting. Fogs are typically used for cooling, and sometimes, for humidification. A mist, as used herein, contains larger particles which fall to create a localized wetting, and are typically used more for providing irrigation.

Because of the difficulty in precisely cutting the small diameter orifice and delivery channel, such prior art nozzles have typically been formed from brass and other relatively soft metals because of the difficulty in working. Recently, some nozzles have been produced in stainless steel, however, such nozzles still follow the design of previous nozzles.

The short delivery channels of the prior art appeared to be necessary because of the limitations of metalworking. Cutting a narrow orifice, typically on the order of six one-thousandths of an inch (0.006 inch), is typically done with a pin drill, usually a stationary drill which engages rotating work. The depth which can be achieved with such a metalworking procedure, typically no greater than fifteen-thousandths of an inch (0.015 inch), is chiefly a function of how well the drill bit can be supported during the metal working process.

Further, and perhaps more important to the present invention, the nature of the metalworking employed to cut the orifice and delivery channel is such that the concentricity of the orifice and the integrity of the orifice and channel walls is difficult to maintain. The drilling operation is known to gouge and scar the interior surface (of the delivery channel and leave an imprecise mouth to the orifice itself.

These problems were addressed in U.S. Pat. No. 4,869,430 to Good. That reference teaches the use of an insert cut from a length of stainless steel surgical tubing. While this reference overcomes many of the difficulties of the prior art, the internal diameter of such tubing is not always dimensionally accurate, and the metalworking of the cut ends of the tubing sometimes distorts the mouth of the orifice. Further, the extrusion process which draws such tubing is primarily concerned with the outside diameter of the finished tubing, and the inside diameter is often imprecise, with fluting and a lack of concentricity being common problems. Such fluting can cause collection of debris, while a lack of concentricity causes a variance in spray patterns. In either case, the variable flow which resulted from piece to piece variations meant that system flow volumes could not be accurately predicted.

Even with the improvements taught in the Good reference, however, it has been difficult, if not impossible, to predict the flow requirements of a system where a plurality of nozzles of different flow rates are employed. Such a situation has rendered it difficult to design efficient spray patterns and regular flow levels.

A pin-jet nozzle is used in a hydraulic system in which the water is pressurized to about 350 to over 1,000 pounds per square inch. At that pressure a thin, substantially-coherent stream of water is forced out through an orifice which is a hole approximately six one-thousandths of an inch in diameter and against an external impingement pin, which is also about six one-thousandths of an inch in diameter, although it is common for larger size impingement pins to be employed.

This creates droplets that are small, small enough that such droplets are essentially unaffected by gravity because of their increased surface area in proportion to their volume. Water droplets of such small dimension evaporate in the air rather than causing localized wetting. With the evaporation of each droplet, it's heat of vaporization is removed from the ambient air, reducing the ambient air temperature. An array of 200 to 300 of these nozzles can cool a large area, even an outdoor area.

Wetting was always the problem with prior art evaporative cooling systems. Not only does wetting mean that cooling isn't being done efficiently, wetting can actually be harmful in many applications, by leading to mildew and mold, and damaging perishables, etc. A nozzle that puts out any significant number of large particles causes wetting, limiting the uses of the cooling system. Wear was one reason why nozzles did not perform in service, but manufacturing irregularities have been a much greater factor. The wear characteristics of a nozzle were unimportant if the nozzle could not be put into service in the first place.

A substantially uniform fog of small particle size has recently become practical, as taught by U.S. patent application Ser. No.: 08/474,947, filed Jun. 7, 1995, claiming priority of application Ser. No.: 07/919,164, filed Jul. 23, 1992, issued Apr. 15, 1997, as U.S. Pat. No. 5,620,142, the teachings of which reference are hereby incorporated by reference, as if fully set forth herein.

With a fog of such small particle size, it has become possible to utilize a water fog for theatrical effects and amusement displays, as well as cooling in environments where people are present. Where fog is employed for effects, however, it is the quantity and opacity of the fog which is generally important, not its cooling capacity. When several nozzles of the type taught in this reference are brought into close proximity to create a fog for theatrical purposes, however, a fog with larger particle size water droplets results. While the reason for this remains conjectural, it is believed that the relatively high kinetic energy of the small water particles issuing from each independent nozzle causes collisions of the particles with the particles from adjacent nozzles, resulting in larger droplet size. As such, the benefits of small particle size fogs have not heretofore been achieved by closely-spaced arrays of these nozzles.

SUMMARY OF THE INVENTION

It is an object of the present invention to provide an ultra-dry fog box for the emission of a fog along a dimension.

The other objects, features and advantages of the present invention will become more apparent in light of the following detailed description of the preferred embodiment thereof.

According to the preferred embodiment of the present invention, there is provided an ultra-dry fog box for the emission of a fog along a dimension, comprising a box-type structure, having a length along which a fog is desired, said box comprising:

1) at least one emission opening along said length of said box-type structure for the emission of a substantially uniform fog;
2) at least one inlet passage permitting the intake of ambient air into said box-type structure;
3) an internal circuitous path within said box-type structure comprising a flow path in fluid communication between said inlet passage and said emission opening, and comprising, at least in part, a near-reversal of a flow from the gravitational direction;
4) means for the creation of flow of ambient air into said box-type structure through said inlet passage and out of said box-type structure through said emission opening;
5) at least one pin jet nozzle adapted for use in providing a fog, said pin-jet nozzle being proximate to said inlet passage or within said box-type structure so that fluid discharge from said pin-jet nozzle will enter said flow path.

According to a further preferred embodiment of the present invention, there is provided an ultra-dry fog box for the emission of a fog along a dimension, comprising a box-type structure, having a length along which a fog is desired, said box comprising:

1) at least one emission opening along said length of said box-type structure for the emission of a substantially uniform fog;
2) at least one inlet passage permitting the intake of ambient air into said box-type structure;
3) an internal circuitous path within said box-type structure comprising a flow path in fluid communication between said inlet passage and said emission opening, and comprising, at least in part, a near-reversal of a flow from the gravitational direction;
4) means for the creation of flow of ambient air into said box-type structure through said inlet passage and out of said box-type structure through said emission opening;
5) at least one improved pin jet nozzle adapted for use in providing a fog consisting essentially of fluid particles having a diameter of less than fifty micrometers (50 μm), said nozzle comprising:
   a. a base portion itself comprising:
      i. means for connection of said nozzle to a pressurized hydraulic system;
      ii. means for receiving fluid from said system; and,
      iii. an orifice component, said orifice component comprising:
         A. an inlet adapted to receive fluid from said system;
         B. an outlet orifice for the release of fluid from said system in the form of a jet; and,
         C. a delivery channel adapted to convey fluid from said inlet to said outlet orifice; and,
   b. a pin portion comprising:
      i. support and centering means; and,
      ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:

i. an insert member comprising a hollow, generally cylindrical insert adapted to be held firmly within the outlet orifice of said base portion; and, ii. an orifice member held firmly within the generally cylindrical insert member, which orifice member comprises:

A. a wear-resistant material;

B. a central orifice with a diameter of from about three one-thousandths of an inch (0.003 in.) to about fifteen one-thousandths of an inch (0.015 in.);

C. a high degree of concentricity, with a variance in the concentricity of said central orifice of less than five ten-thousandths of an inch (0.0005);

said pin-jet nozzle being proximate to said inlet passage or within said box-type structure so that fluid discharge from said pin-jet nozzle will enter said flow path.

According to a still further preferred embodiment, these devices of the present invention further provide at least one mesh filter disposed within said flow path for fluid particles.

DETAILED DESCRIPTION OF THE PREFERRED EMBODIMENT

As with any pressurized discharge, the integrity of the cylindrical barrel from which the discharge issues will help determine the quality of its trajectory. The necessities of metalworking in the manufacture of a pin jet nozzle have, in the past, adversely affected the integrity of the delivery channel, or barrel, of the nozzle. The integrity of the interior surface of the delivery channel and the orifice opening itself are typically compromised by such metalworking.

Figure 1:
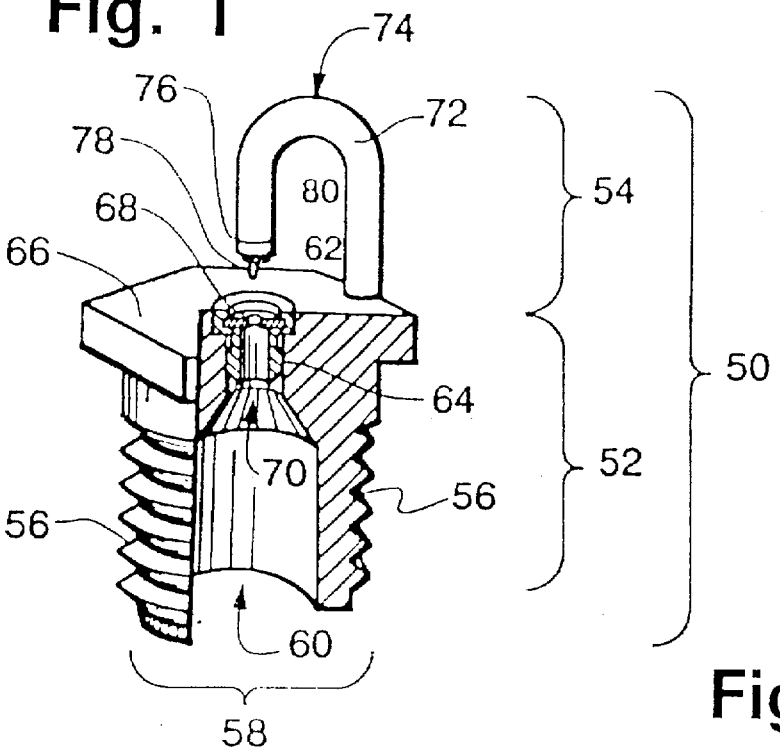
FIG. 1, partly in cross-section, shows the jeweled-orifice fog nozzle employed in the preferred embodiment of the present invention.

In the present invention, as shown in FIG. 1, a pin jet nozzle (50) is generally comprised of a base portion (52) and a pin portion (54). The base portion further comprises means for connection of the nozzle to a pressurized hydraulic system (not shown), which means are represented as the screw threads (56). These screw threads (56) enable the nozzle to be directly connected into such a system, but other means well known to the art may alternatively be employed. As in the prior art, the open bottom (58) of the base portion (52) and an internal chamber (60) serve as a means for receiving fluid from the hydraulic system. A larger dimensioned orifice outlet (70) penetrates the cap (66) of base portion (52) in place of the tiny drilled hole of the prior art. This outlet orifice (70) is drilled through the cap (66) of the base portion (52), but drilling is not believed to be sufficiently accurate to effect a water-tight seal when a nozzle insert is positioned within the outlet orifice (70), and the drilled hole is reamed to remove irregularities and increase concentricity.

Although similar in function to the simplistic orifice component of the prior art, the nozzle of the present invention has an improved nozzle insert (62) penetrating the cap (66) of the base portion (52). The nozzle insert (62) comprises an insert member (64), and an orifice member (68).

Figure 1A:
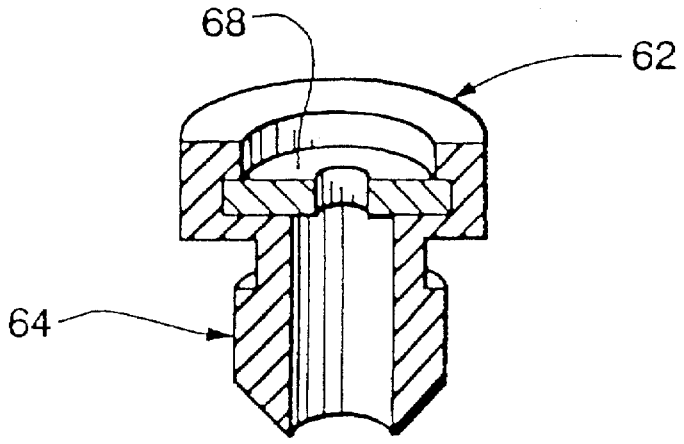
FIG. 1A, partly in cross-section, shows detail of the insert in the jeweled-orifice fog nozzle of FIG. 1.

The nozzle insert (62) of the present invention is further illustrated in FIG. 1A. In that drawing, the insert member (64) may be seen to be a hollow, generally cylindrical insert adapted to be held firmly within the orifice outlet (70) of the base portion (52). This nozzle insert may be prepared from any suitable material, but nickel silver and stainless steel has been shown to work effectively for this purpose.

The orifice member (68) is also shown in greater detail in FIG. 1A. As illustrated, the orifice member (68) comprises a small element of wear-resistant material, such as artificial ruby or sapphire, or a similar material, and contains within it a central orifice of suitable diameter, and high inside diameter tolerance. The shape of the orifice member outside the central orifice area is not critical, but the flat disk illustrated has been shown to be preferred for ease in locating the orifice member (68) within the nozzle insert (62).

This orifice member (68) is prepared from a ruby or sapphire wafer to precise tolerances, including at least one surface which is smooth and polished with no surface pocketing, scaring, voids, or imperfections. A precise orifice mouth is cut with a laser, and then polished by wire polishing to a tolerance which is simply not possible with drilling or extrusion technology.

The orifice member (68) of the present invention is held firmly within the generally cylindrical insert member (64) as shown in the drawing, and this may be accomplished with standard metalworking techniques to expand a portion of the metal of insert member (64) over the surface of orifice member (68). The orifice member (68) should be held in a flat position, generally parallel to the nozzle surface. Other methods, which do not compromise the integrity of the orifice member, may be employed.

Referring to FIG. 1, once again, the pin portion (54) of the nozzle (50) of the present invention comprises a support and centering means (72) as in the prior art, which is typically an arched post (74) affixed onto or into the cap (66) of the base portion (52). The arched post (74) has at its terminal end (76) an impingement pin (78) with impingement face (80). By virtue of the tolerance of the orifice and the integrity of the orifice mouth, which define an exact output for each nozzle, the impingement pin (78) and the diameter of the impingement face (80) may be smaller in diameter than a comparable impingement pin of the pin jet nozzle of the prior art. It has been common in the prior art to provide an impingement pin larger in diameter than the outlet orifice. As in the prior art, the impingement pin is preferably positioned directly outward to the outlet orifice at a fixed distance.

Again, the exact dimension of the pin, its position and the geometry of its taper are believed to be within the knowledge of one skilled in the art.

To prepare a nozzle of the present invention, a blank base portion is drilled out to accommodate the insertion of a nozzle insert which is separately prepared. Thus, the blank base is not drilled with a pin drill, but with a drill of approximately six hundredths of an inch (0.06 inch). This drilling procedure, because of the great difference in size and because of the fact that it is not intended to define an opening in the finished nozzle, does not require the extreme accuracy of the drilling operation of the prior art.

The base may at the same time be drilled to accommodate the support and centering means of the pin portion and, because the blank need not be cut as deeply, the pin may be seated to a greater depth, adding to its strength and stability.

As noted previously, the nozzle insert is separately prepared from a machined insert member, into which an orifice member has been placed and secured, as described above. The nozzle insert (62) is then placed into the orifice outlet (70) and secured. In practice, this has been done by preparing the insert member (64) in a form which would permit it to be pressed into the orifice outlet (70) in a high tolerance press-fit engagement. This may be done by any method known to the art which will preserve the integrity of the inlet and the central orifice, and not compromise the fluid delivery.

Once the base portion of the nozzle has been assembled in this manner, the pin portion can be added in the manner of the prior art to provide the improved pin jet nozzle of the present invention.

The pin jet nozzle employed in the present invention represents a distinct improvement over the nozzles available to the prior art. The central orifice of the orifice member may be prepared with a tolerance (within 0.0002 inch) unknown to the prior art, while its wear-resistant characteristics provide a long service life of true dimensional stability not previously available. Further test results have shown that with an orifice of such true dimension, a smaller impingement pin can be employed, and less fluid is used to provide a better quality droplet dispersion in fogging.

Tests of the improved pin jet nozzle of the present invention have shown a greatly improved consistency in flow rate. With an orifice of six one-thousandths of an inch, nozzles of the present invention can be represented to provide flows of from two hundred twenty ten-thousandths of a gallon per minute (0.0220 GPM) to about two hundred twenty-five ten-thousandths of a gallon per minute (0.0225 GPM). In testing, the improved pin jet nozzle of the present invention will consistently deliver flows of two hundred twenty-one ten-thousandths of a gallon per minute (0.0221 GPM) to two hundred twenty--three ten-thousandths of a gallon per minute (0.0223 GPM).

Such reproducible flow rates compare very favorably with the prior art, where nozzle flows may vary as much as eleven percent (11%) to eighteen percent (18%) on a nozzle-to-nozzle basis. Such reproducibility is of great importance in the design of a system, where system capacities depend critically on the total output of several hundred such nozzles.

Equally valuable in the nozzle of the present invention is the ability to provide fluid droplets of limited particle size. As noted previously, in evaporative cooling applications, small particles evaporate rather than causing localized wetting. This is because the volume of the particle is smaller than its surface area (the cube of its diameter is smaller than the square of its diameter). With larger particles, however, wetting can occur, meaning that cooling is not occurring for such particles. Phase-Doppler Anemometry results have shown this nozzle capable of providing a droplet dispersion in which approximately half of the droplets are smaller than fifteen micrometers (15 μm.). Further, about ninety percent of the droplets are smaller than thirty micrometers (30 μm.) and substantially all of the droplets are smaller than fifty micrometers (50 μm.). Nothing in the prior art was capable of such small and uniform particle dispersion.

Nozzles of this design have permitted fog to be created for other purposes, as well. In addition to cooling and humidification, fog can now be created for theatrical purposes and special effects, such as in amusement parks and the like. In these uses, where the thickness and opacity of the fog are desired, rather than its cooling abilities, a group of nozzles are employed together to combine the outputs of each nozzle. When this is done, however, a larger proportion of larger particle size droplets typically results.

It is believed that this is the result of the high kinetic energy of droplets created in close proximity to each other, and the higher probability of collisions at that proximity and kinetic energy. The localized wetting which results from such larger particle size droplets has limited the applications where a fog created in this manner can be employed. It would not be acceptable, for example, to have patrons on an amusement ride pass through a curtain of fog if such larger particle size droplets cause any significant wetting to such patrons.

Figure 2:
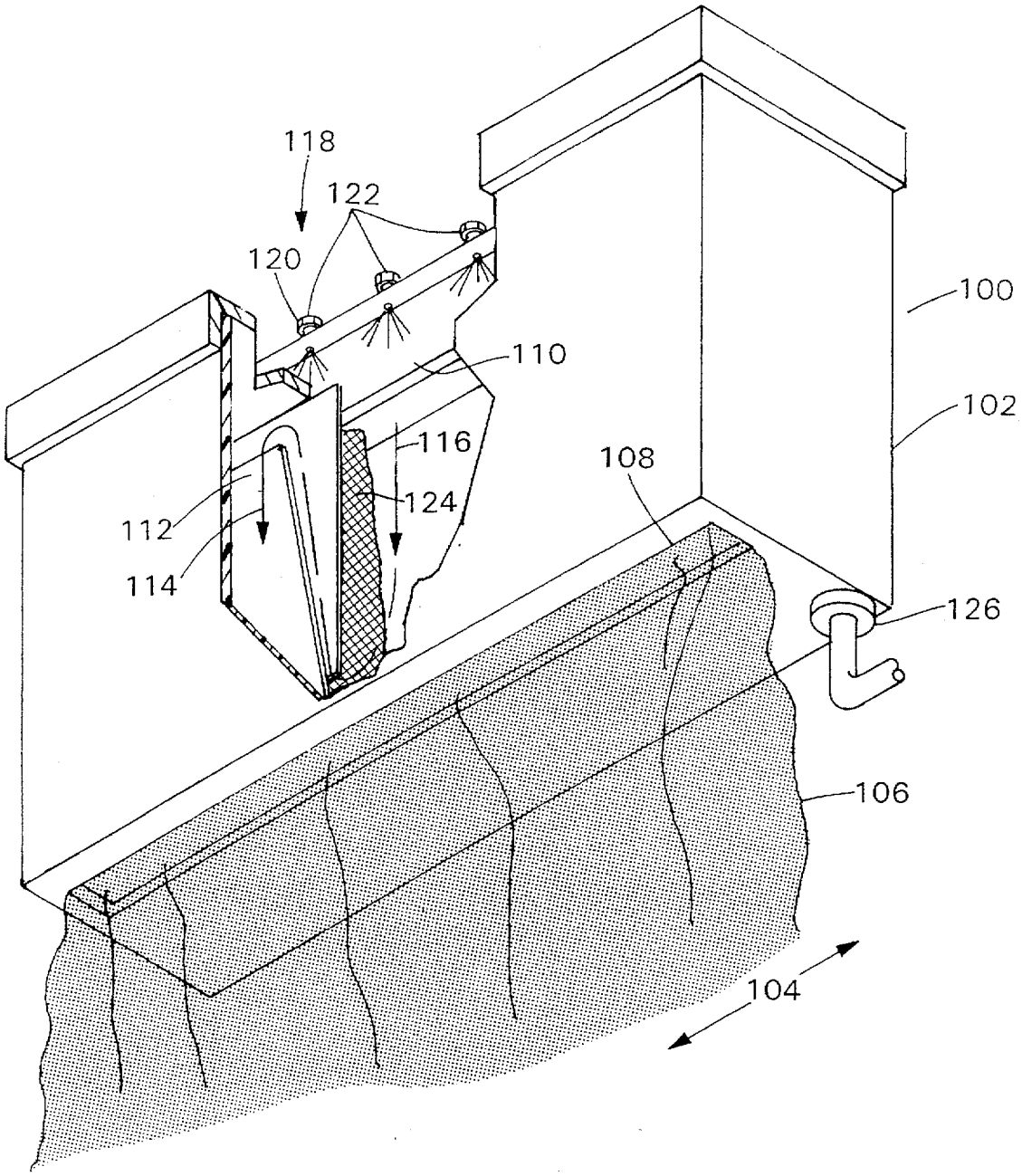
FIG. 2, partly in cross section, shows the ultra-dry fog box of the present invention, with a fog issuing forth in a vertical direction.

An effort to create useful effects of this nature has now resulted in the present invention, an ultra-dry fog box 100, as shown in FIG. 2, for the emission of a fog along a dimension. This is accomplished in a box-type structure 102, having a length 104 along which a fog 106 is desired, and at least one emission opening 108 along the length of the box-type structure 102 for the emission of a substantially uniform fog 106. Such a box-type structure 102 can be fabricated from any suitable material which will withstand the effects of moisture during its service life, and various thermoformed resin plastics are regarded to be preferable for this use. In particular, polyvinyl chloride (PVC) plastics have been used for this purpose with suitable results.

With continued reference to FIG. 2, the box-type structure 102 further comprises at least one inlet passage 110 permitting the intake of ambient air into the box-type structure 102. Within the box-type structure 102, there is an internal circuitous path 112 comprising a flow path 114 in fluid communication between the inlet passage 110 and the emission opening 108, and comprising, at least in part, a near-reversal of a flow from the gravitational direction, shown as 116 in FIG. 3. In practice, this near reversal of flow from the gravitational direction should be from about ninety degrees (90°) to about one hundred eighty degrees (180°). A preferred range is from about one hundred thirty-five degrees (135°) to about one hundred seventy-five degrees (175°).

Some means 118 for the creation of flow of ambient air into the box-type structure 102 through the inlet passage 110 and out of the box-type structure 102 through the emission opening 108. This air flow may be created by something as simplistic as the low-pressure created by an array of nozzles directed into the inlet passage 110, or by more active means such as one or more fans internally or externally, directing the flow, or any other convenient means known to the art.

As shown in FIG. 2, the present invention further comprises at least one pin jet nozzle 120 adapted for use in providing a fog. In the preferred embodiment of FIG. 2, there is shown an array 122 of such nozzles proximate to the inlet passage 110, though such array 122 could be located completely outside or completely inside the box-type structure 102 so long as the fluid discharge from each pin-jet nozzle 120 will enter the flow path 114.

In the preferred embodiment it has been found useful to provide at least one mesh filter 124 disposed within the flow path 114 to trap large fluid particles. In practice, this can be accomplished with a layer of loose cell foam such as the open-cell foams commercially available from New Dimensions, Inc., of Moonachie, N.J., under the tradename New Dimensions™. Another mist eliminator foam, which has bee used successfully, is that commercially available from the Kimre Corporation of Florida. A combination of these mist eliminator foams has also been used successfully.

Some means 126 of draining collected water from the box-type structure 102 to a remote location is also considered useful. One skilled in the art would understand that such a drain should ideally be located at the lowest point of the box-type structure 102, and provide drainage for the entire structure.

In FIG. 2, the design is intended to provide a vertical discharge, to create, in effect, a curtain of fog. Such a design is useful for amusement rides, where ride patrons are carried through a curtain of fog. Alternatively, the design can be used to dramatically close an opening, such as the entrance to a restaurant, or a partition within a restaurant or other public building.

Figure 3:
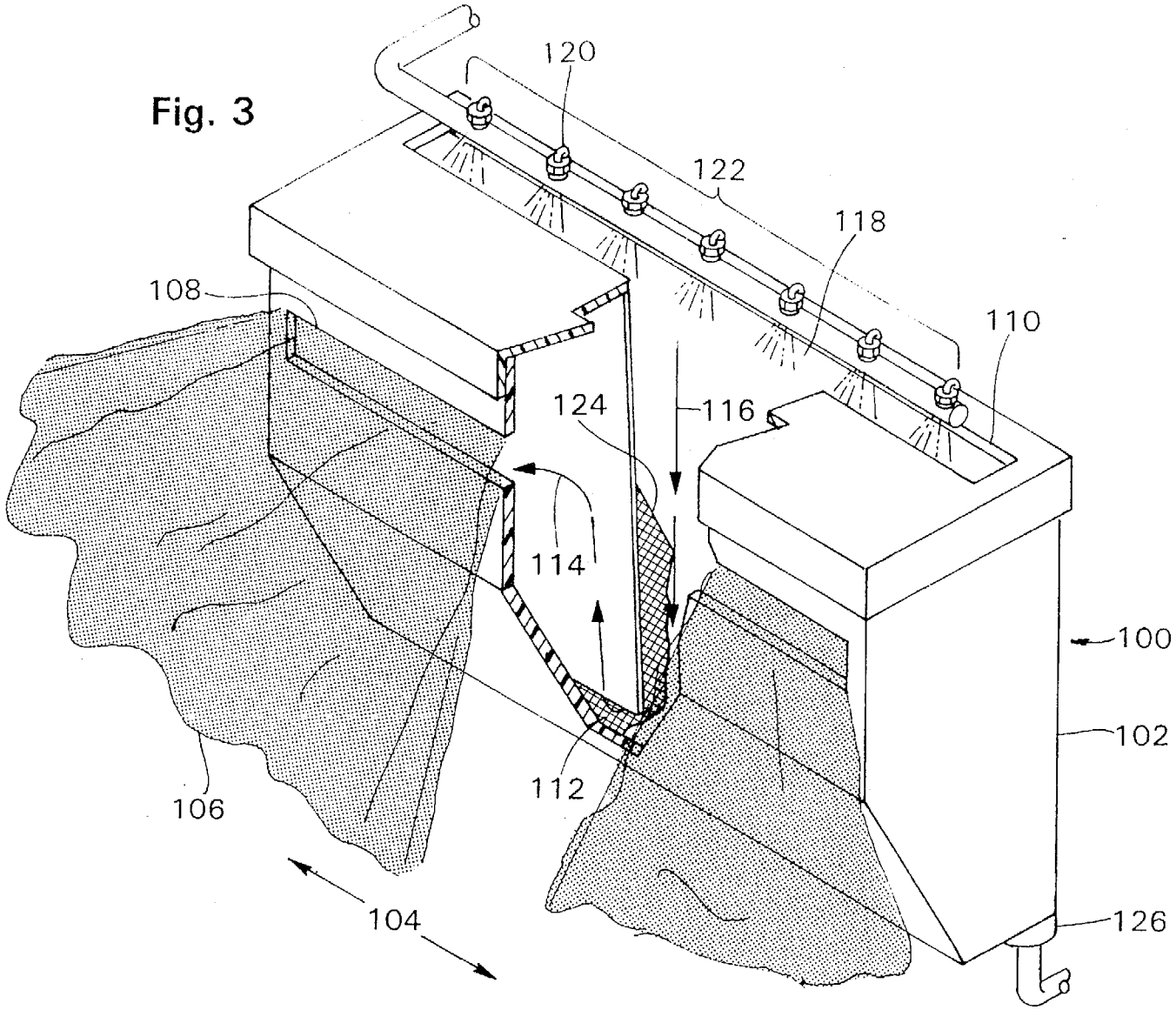
FIG. 3, partly in cross section, shows the ultra-dry fog box of the present invention, with a fog issuing forth in a horizontal direction.

In FIG. 3, a design is shown which is intended to provide a horizontal discharge. Such a design would be useful to provide a layer of fog, typically across a floor or path, with useful visual effect. The various components of FIG. 3 are detailed with the same identification numbers as used hereinabove for FIG. 2. One skilled in the art will recognize that the two embodiments function in the same manner throughout, except the flow path 114 of the design of FIG. 3 is shorter because the emission opening can be placed earlier.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An ultra-dry fog box for the emission of a fog along a dimension, comprising a fog retention enclosure, having a length along which a fog is desired, said enclosure comprising:

1) at least one emission opening along said length of said fog retention enclosure for the emission of a substantially uniform fog;

2) at least one inlet passage permitting an intake of ambient air into said fog retention enclosure;

3) an internal circuitous path within said fog retention enclosure comprising a flow path in fluid communication between said inlet passage and said emission opening, and comprising, at least in part, a near-reversal of a flow from a gravitational direction;

4) means for creating a flow of ambient air into said fog retention enclosure through said inlet passage and out of said fog retention enclosure through said emission opening;

5) at least one pin jet nozzle adapted for use in providing a fog, said pin-jet nozzle being proximate to said inlet passage or within said fog retention enclosure so that fluid discharge from said pin-jet nozzle will enter said flow path.

2. The ultra-dry fog box of claim 1 wherein the fog retention enclosure is comprised of a thermoformed plastic resin.

3. The ultra-dry fog box of claim 2 wherein the fog retention enclosure is comprised of polyvinyl chloride.

4. The ultra-dry fog box of claim 1 wherein the near-reversal of flow from a gravitational direction is from about ninety degrees (90°) to about one hundred eighty degrees (180°) from the gravitational direction.

5. The ultra-dry fog box of claim 4 wherein the near-reversal of flow from a gravitational direction is from about one hundred thirty-five degrees (135°) to about one hundred seventy-five degrees (175°) from the gravitational direction.

6. The ultra-dry fog box of claim 1 wherein the means for creating an ambient air flow into said fog retention enclosure comprises a low-pressure created by the discharge of an array of pin-jet nozzles.

7. The ultra-dry fog box of claim 1 wherein the means for creating an ambient air flow into said fog retention enclosure comprises a means to force air into said fog retention enclosure.

8. An ultra-dry fog box for the emission of a fog along a dimension, comprising a fog retention enclosure, having a length along which a fog is desired, said enclosure comprising:

1) at least one emission opening along said length of said fog retention enclosure for the emission of a substantially uniform fog;

2) at least one inlet passage permitting an intake of ambient air into said fog retention enclosure;

3) an internal circuitous path within said fog retention enclosure comprising a flow path in fluid communication between said inlet passage and said emission opening, and comprising, at least in part, a near-reversal of a flow from a gravitational direction;

4) means for creating a flow of ambient air into said fog retention enclosure through said inlet passage and out of said fog retention enclosure through said emission opening;

5) at least one pin jet nozzle adapted for use in providing a fog, said pin-jet nozzle being proximate to said inlet passage or within said fog retention enclosure so that fluid discharge from said pin-jet nozzle will enter said flow path; and, 6) at least one mesh filter disposed within said flow path for fluid particles.

9. The ultra-dry fog box of claim 8 wherein the fog retention enclosure is comprised of a thermoformed plastic resin.

10. The ultra-dry fog box of claim 9 wherein the fog retention enclosure is comprised of polyvinyl chloride.

11. The ultra-dry fog box of claim 2 wherein the near-reversal of flow from a gravitational direction is from about ninety degrees (90°) to about one hundred eighty degrees (180°) from the gravitational direction.

12. The ultra-dry fog box of claim 11 wherein the near-reversal of flow from a gravitational direction is from about one hundred thirty-five degrees (135°) to about one hundred seventy-five degrees (175°) from the gravitational direction.

13. The ultra-dry fog box of claim 8 wherein the means for creating an ambient air flow into said fog retention enclosure comprises a low-pressure created by the discharge of an array of pin-jet nozzles.

14. The ultra-dry fog box of claim 8 wherein the means for creating an ambient air flow into said fog retention enclosure comprises a means to force air into said fog retention enclosure.

15. The ultra-dry fog box of claim 2 wherein said at least one mesh filter comprises an open-cell foam.

16. The ultra-dry fog box of claim 8 wherein said at least one mesh filter comprises a mist eliminator foam.

17. An ultra-dry fog box for the emission of a fog along a dimension, comprising a fog retention enclosure, having a length along which a fog is desired, said enclosure comprising:

1) at least one emission opening along said length of said fog retention enclosure for the emission of a substantially uniform fog;

2) at least one inlet passage permitting an intake of ambient air into said fog retention enclosure;

3) an internal circuitous path within said fog retention enclosure comprising a flow path in fluid communication between said inlet passage and said emission opening, and comprising, at least in part, a near-reversal of a flow from a gravitational direction;

4) means for creating a flow of ambient air into said fog retention enclosure through said inlet passage and out of said fog retention enclosure through said emission opening;

5) at least one improved pin jet nozzle adapted for use in providing a fog consisting essentially of fluid particles having a diameter of less than fifty micrometers (50 μm), said nozzle comprising:

a. a base portion itself comprising:

i. means for connection of said nozzle to a pressurized hydraulic system;

ii. means for receiving fluid from said system; and, iii. an -orifice component, said orifice component comprising:

A. an inlet adapted to receive fluid from said system;

B. an outlet orifice for the release of fluid from said system in the form of a jet; and, C. a delivery channel adapted to convey fluid from said inlet to said outlet orifice; and, b. a pin portion comprising:

i. support and centering means; and, ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:

i. an insert member comprising a hollow, generally cylindrical insert adapted to be held firmly within the outlet orifice of said base portion; and, ii. an orifice member held firmly within the generally cylindrical insert member, which orifice member comprises:

A. a wear-resistant material;

B. a central orifice with a diameter of from about three one-thousandths of an inch (0.003 in.) to about fifteen one-thousandths of an inch (0.015 in.);

C. a high degree of concentricity, with a variance in the concentricity of said central orifice of less than five ten-thousandths of an inch (0.0005);

said pin-jet nozzle being proximate to said inlet passage or within said fog retention enclosure so that fluid discharge from said pin-jet nozzle will enter said flow path.

18. The ultra-dry fog box of claim 17 wherein the orifice member is comprised, in principle part, of ruby.

19. The ultra-dry fog box of claim 17 wherein the orifice member is comprised, in principle part, of sapphire.

20. The ultra-dry fog box claim 17 wherein the orifice member has a diameter of about three one-thousandths of an inch (0.003 in.) to about twelve one-thousandths of an inch (0.012 in.).

21. The ultra-dry fog box of claim 20 wherein the orifice member has a diameter of about five one-thousandths of an inch (0.005 in.).

22. The ultra-dry fog box of claim 20 wherein the orifice member has a diameter of about fifty-five ten-thousandths of an inch (0.0055 in.).

23. The ultra-dry fog box of claim 20 wherein the orifice member has a diameter of about six one-thousandths of an inch (0.006 in.).

24. The ultra-dry fog box of claim 17 wherein the variation in the concentricity of said orifice member is less than two ten-thousandths of an inch (0.0002 in.).

25. An ultra-dry fog box for the emission of a fog along a dimension, comprising a fog retention enclosure, having a length along which a fog is desired, said enclosure comprising:

1) at least one emission opening along said length of said fog retention enclosure for the emission of a substantially uniform fog;

2) at least one inlet passage permitting an intake of ambient air into said fog retention enclosure;

3) an internal circuitous path within said fog retention enclosure comprising a flow path in fluid communication between said inlet passage and said emission opening, and comprising, at least in part, a near-reversal of a flow from a gravitational direction;

4) means for creating a flow of ambient air into said fog retention enclosure through said inlet passage and out of said fog retention enclosure through said emission opening;

5) at least one improved pin jet nozzle adapted for use in providing a fog consisting essentially of fluid particles having a diameter of less than fifty micrometers (50 μm), said nozzle comprising:

a. a base portion itself comprising:

i. means for connection of said nozzle to a pressurized hydraulic system;

ii. means for receiving fluid from said system; and, iii. an orifice component, said orifice component comprising:

A. an inlet adapted to receive fluid from said system;

B. an outlet orifice for the release of fluid from said system in the form of a jet; and, C. a delivery channel adapted to convey fluid from said inlet to said outlet orifice; and, b. a pin portion comprising:

i. support and centering means; and, ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:

i. an insert member comprising a hollow, generally cylindrical insert adapted to be held firmly within the outlet orifice of said base portion; and, ii. an orifice member held firmly within the generally cylindrical insert member, which orifice member comprises:

A. a wear-resistant material;

B. a central orifice with a diameter of from about three one-thousandths of an inch (0.003 in.) to about fifteen one-thousandths of an inch (0.015 in.);

C. a high degree of concentricity, with a variance in the concentricity of said central orifice of less than five ten-thousandths of an inch (0.0005);

said pin-jet nozzle being proximate to said inlet passage or within said fog retention enclosure so that fluid discharge from said pin-jet nozzle will enter said flow path; and, 6) at least one mesh filter disposed within said flow path for fluid particles.

26. The ultra-dry fog box claim 25 wherein the orifice member is comprised, in principle part, of ruby.

27. The ultra-dry fog box of claim 25 wherein the orifice member is comprised, in principle part, of sapphire.

28. The ultra-dry fog box claim 25 wherein the orifice member has a diameter of about three one-thousandths of an inch (0.003 in.) to about twelve one-thousandths of an inch (0.012 in.).

29. The ultra-dry fog box of claim 28 wherein the orifice member has a diameter of about five one-thousandths of an inch (0.005 in.).

30. The ultra-dry fog box of claim 28 wherein the orifice member has a diameter of about fifty-five ten-thousandths of an inch (0.0055 in.).

31. The ultra-dry fog box of claim 28 wherein the orifice member has a diameter of about six one-thousandths of an inch (0.006 in.).

32. The ultra-dry fog box of claim 25 wherein the variation in the concentricity of said orifice member is less than two ten-thousandths of an inch (0.0002 in.).

* * * * *